United States Patent [19]

Ball

[11] 4,005,747

[45] Feb. 1, 1977

[54] MULTI-FLOW, MULTI-PATH HEAT EXCHANGER FOR PUMP-MECHANICAL SEAL ASSEMBLY

[75] Inventor: Rowland E. Ball, Long Beach, Calif.

[73] Assignee: Borg-Warner Corporation, Chicago, Ill.

[22] Filed: June 27, 1975

[21] Appl. No.: 590,884

[52] U.S. Cl. ..... 165/134; 277/3; 277/15; 277/22; 415/112

[51] Int. Cl.[2] ..... F16J 15/44

[58] Field of Search ..... 277/15, 16, 22; 415/175, 176, 178, 112; 417/368, 372; 165/134

[56] References Cited

UNITED STATES PATENTS

| | | | |
|---|---|---|---|
| 1,779,055 | 10/1930 | Taylor | 277/22 |
| 1,806,929 | 5/1931 | Bath | 277/22 |
| 2,990,202 | 6/1961 | Dennison | 277/22 |
| 3,459,430 | 8/1969 | Ball | 277/3 |
| 3,652,179 | 3/1972 | Hagen | 415/112 |
| 3,732,029 | 5/1973 | Raymond et al. | 415/112 |
| 3,843,140 | 10/1974 | Mayer et al. | 277/15 |

*Primary Examiner*—Charles J. Myhre
*Assistant Examiner*—Daniel J. O'Connor
*Attorney, Agent, or Firm*—Aubrey L. Burgess

[57] ABSTRACT

A multi-flow, multi-path heat exchanger which surrounds the shaft of a coolant pump and is located between the pump impeller and a mechanical seal assembly for cooling hot liquid from the pump chamber flowing along the shaft to the mechanical seal assembly. The heat exchanger finds particular use with high-temperature, high-pressure pumps or with other pumps in which similar heat problems occur.

5 Claims, 5 Drawing Figures

MULTI-FLOW, MULTI-PATH HEAT EXCHANGER FOR PUMP-MECHANICAL SEAL ASSEMBLY

BACKGROUND OF THE INVENTION

The use of heat exchangers for cooling hot liquid from a pump chamber which flows along the pump shaft to a mechanical seal assembly associated with the pump is well known in the art. One such arrangement is illustrated and described in my prior U.S. Pat. No. 3,459,430, granted July 6, 1967. The heat exchanger described in this patent includes a pair of concentric coils one for liquid flowing to the stuffing box and the other for liquid flowing through a pressure-breakdown means associated with the mechanical seals. The coils are contained within in concentric jackets which communicate with one another at the lower ends. A coolant, such as water or other fluid, is introduced into the top of the outermost jacket, so as to flow downwardly and over the coils in that jacket, through the lower end of the innermost jacket and then out the top of the innermost jacket. Cooling of the liquid in the coils is accomplished by mass flow of coolant into and out of the jackets; cooling may be non-uniform because of the irregular paths of flow available to the coolant; there may be hot spots which recieve little or no cooling. Further, the heat exchanger of the prior art patent will provide cooling for all mechanical seals only in running condition; when the pump assembly is in hot, stand-by condition, the bottom seals are not cooled while the top seals are cooled, because of the requirements for a recirculating impeller for the heat exchanger.

THE INVENTION

According to the invention to be described herein, an improved heat exchanger is provided in a pump assembly incorporating mechanical seals such that the seals are cooled not only in running but in hot-stand-by condition. No recirculating impeller is required for the heat exchanger. However, to enhance heat exchange, the heat exchanger is constructed with a rotating baffle which defines the path of hot fluid flow and which when rotating, causes rotational motion in the hot fluid. The heat exchanger is so constructed that coolant flows in a defined path, thus insuring a relatively uniform cooling effect on the hot liquid flowing along the pump shaft to the mechanical seals. The invention finds particular use in conjunction with a high-temperature, high-pressure pump or in other arrangements where similar conditions are found to exist.

THE DRAWINGS

DETAILED DESCRIPTION

Figure 1:
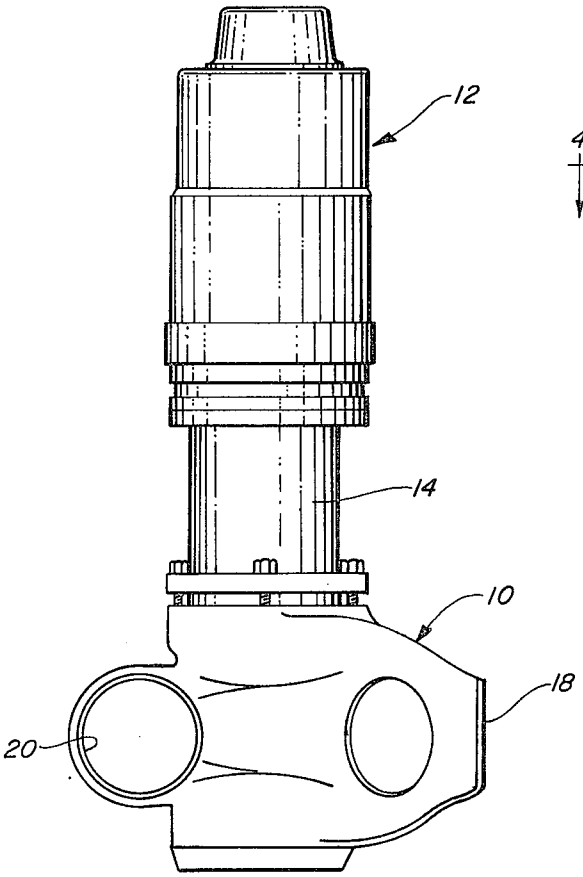
FIG. 1 is an elevational view of a pump-motor unit which incorporates a mechanical seal and a heat exchanger according to this invention.
Figure 2:
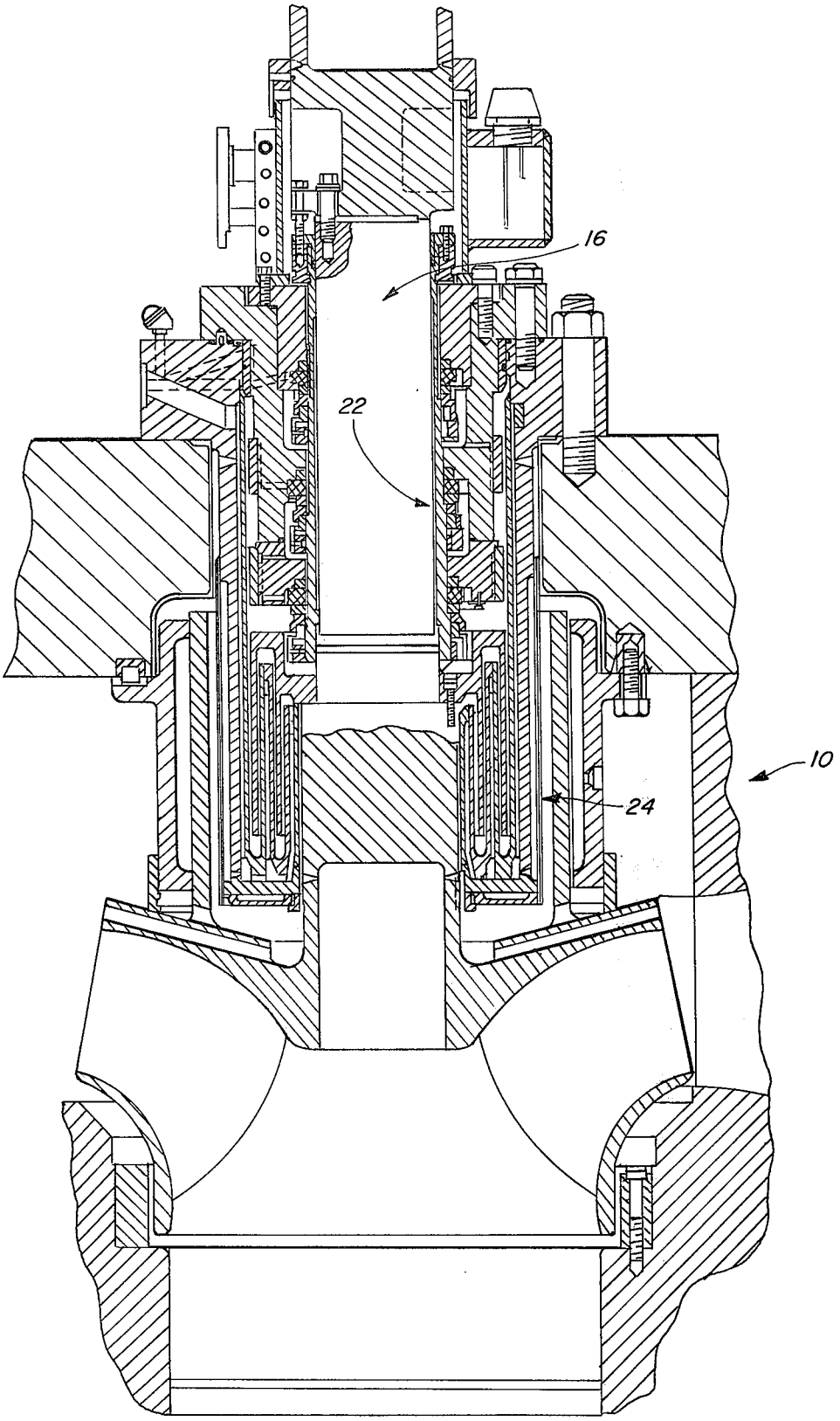
FIG. 2 is an enlarged, axial, sectional view of a portion of the structure of FIG. 1 and especially showing the relationship of the heat exchanger of this invention, the pump and the mechanical seal assembly.

Referring now to FIGS. 1 and 2 of the drawings, the assembly to be described comprises a pump 10 and a motor 12 supported on the pump, by a cylindrical housing 14, the pump and motor being connected by a drive line shaft assembly 16, as can be seen in FIG. 2. The pump 10 and the motor 12 are generally conventional in construction, and, as such, the pump 10 is illustrated as a volute type double-suction pump having an intake or suction opening 18 and a discharge opening 20, while the motor 12 may be of any suitable construction or type.

A mechanical seal arrangement which is generally identified as 22 is disposed around the pump shaft to substantially contain the high-pressure fluid in the pump. The mechanical seal assembly 22 forms no part of this invention and is conventional in construction. It is shown as of multiple elements and assemblies for purposes of illustration. Between the pump 10 and the mechanical seal assembly 22 and surrounding the shaft or drive line assembly 16 is a heat exchanger, generally identified as 24.

For purposes of further description, attention is directed to FIGS. 3 to 6 inclusive which illustrate, in a simplified version, the heat exchanger 24 of this invention.

Figure 3:
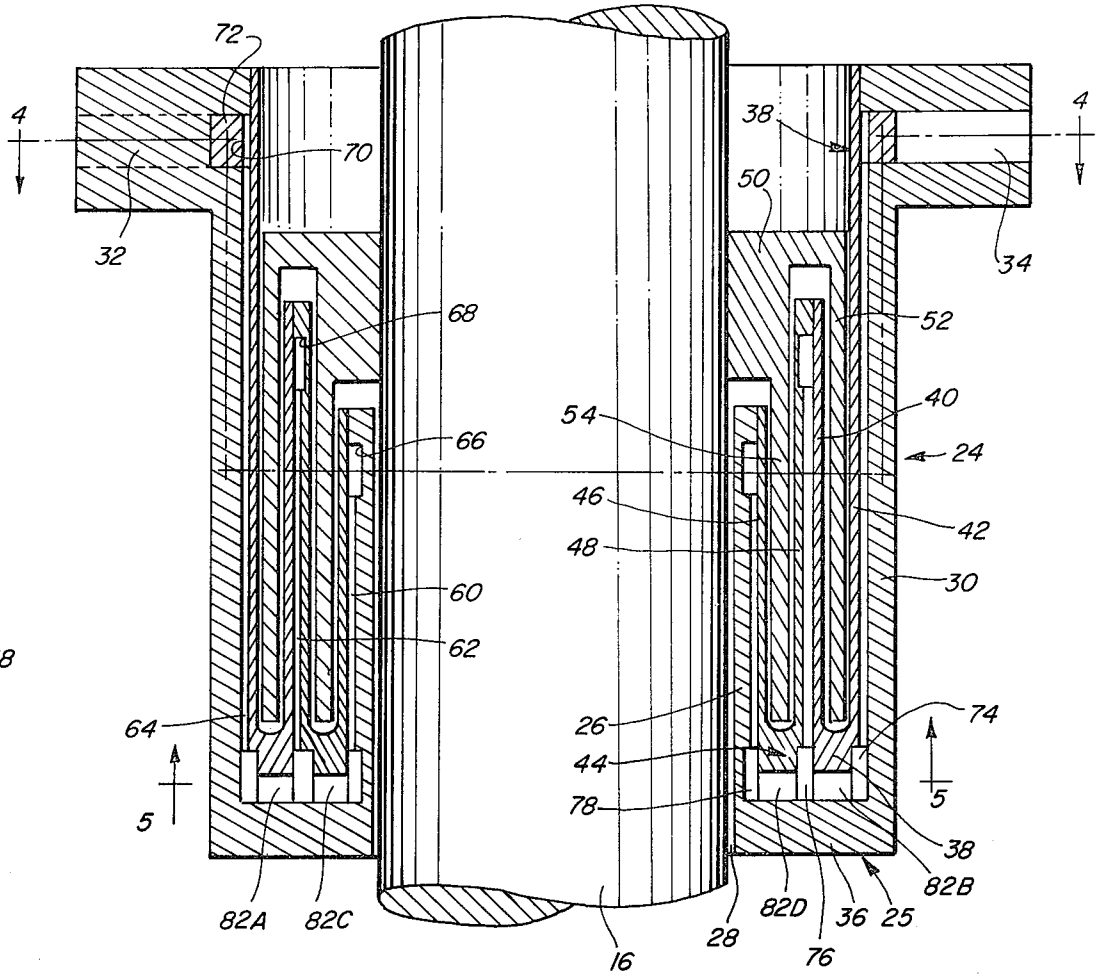
FIG. 3 is a sectional view taken on line 3—3 of FIG. 4 and through a simplified view of the heat exchanger of this invention.
Figure 4:
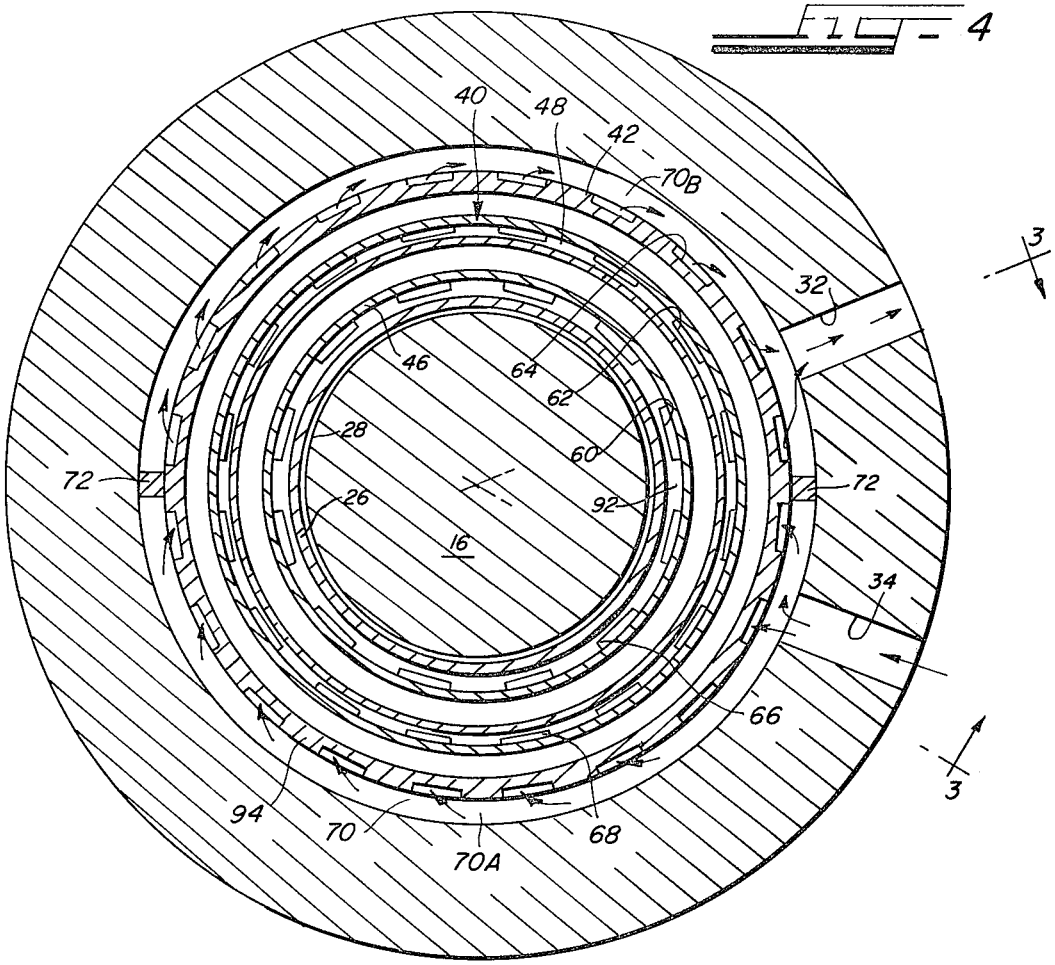
FIG. 4 is a sectional view taken on line 4—4 of FIG. 3.

Parts 52 and 54 are omitted in FIG. 4 for sake of clarity; they are illustrated in FIG. 3.

The heat exchanger 24 comprises a first cup-like cylindrical member 25 having a first and inner axial cylindrical portion 26 having an inside diameter 28 which surrounds the drive line shaft 16 and is slightly spaced from the shaft to permit the flow of hot fluid along the shaft to the heat exchanger, and a second and outer axial cylindrical portion 30 with a coolant fluid inlet 32 and a coolant fluid outlet 34. A radial portion or end wall 36 joints the portions 26 and 30. The heat exchanger also comprises a second cup-like cylindrical member 38 having inner and outer axial portions 40 and 42, respectively, the portion 42 of which engages the inner diameter of the portion 30 of the member 25. The end of the member 38 is spaced from the end wall 36. A third cup-like cylindrical member 44 having an inner and outer axial portion 46 and 48, respectively, is received in the assembly 24; the portion 46 engages the portion 26 of the member 25 and the portion 48 engages the portion 40 of the member 38. The heat exchanger also includes a fourth cup-like cylindrical baffle member 50 fixed to rotate with the shaft 16 and having cylindrical portions 52 and 54 fitting within and spaced from the members 38 and 44 forming joined circular and axial passageways for the flow of hot fluid from the pump to the mechanical seal arrangement.

The portion 26 of the member 25, the portion 48 of the member 44 and the portion 42 of the member 38 are each provided with a plurality of circumferentially spaced, axially oriented slots or grooves 60, 62 and 64, respectively. Also, there are a series of circular passages or circumferential grooves 66, 68 and 70; the passage 66 communicating with the slots or grooves 60; the passage 68 with the slots or grooves 62, and the passage 70 with the slots or grooves 64 and also with the inlet and outlet 32 and 34, respectively. The groove 70 is blocked by radially opposite fluid divider means 72 forming semi-circular grooves or segments 70A and 70B. Circular passages or circumferential grooves 74, 76 and 78 are provided at the opposite end of the heat exchanger which are blocked by radially opposite fluid divider means 80A, 80B and 80C, respectively, thus forming semi-circular grooves or segments 74A, 74B, 76A, 76B, and 78A, 78B, respectively. However, spaced 90° from each fluid divider means 80A, 80B and 80C are intercommunicating passages 82A, 82C and 82B, 82D, respectively. Passage 82A joins grooves 74A and 76A, and passage 82C joins grooves 76A and 78A. On the opposite side, passage 82B joins grooves 74B and 76B, and passage 82D joins grooves 76B and 78B.

As seen in FIG. 4, between the axial slots 62 there are ribs 90 that support the inner axial portion 40 of the cylindrical member 38. These ribs are integral with the outer axial portion 48, previously referred to. Thus, the inner axial portion 40 is supported against the fluid pressure differential existing across it between the axial slots 62 and the high pressure side of the aforementioned inner axial portion 40. Similarly, the inner axial portion 46 of the cylindrical member 44 is supported by the ribs 92 on the previously mentioned cylindrical portion 26. In like manner, the outer axial cylindrical portion 30 of cylindrical member 25 is supported by the ribs 94 of outer axial portion 42 of the cylindrical member 38.

The structure just described provides two paths of fluid flow, i.e., a path of flow for hot fluid flowing along the shaft 16 to the mechanical seal arrangement 22 (after being cooled in the heat exchanger) and a path for coolant flowing through the heat exchanger.

Figure 5:
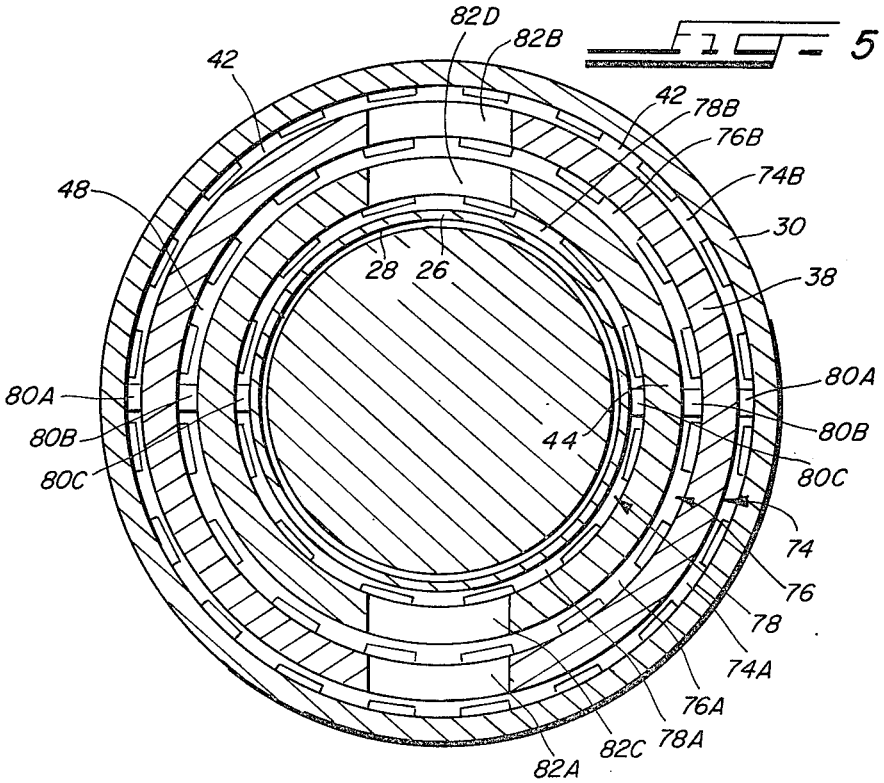
FIG. 5 is a sectional view taken on line 5—5 of FIG. 3.

The path of the fluid flow through the heat exchanger will be described with reference to FIGS. 3, 4 and 5. The arrows in FIGS. 4 and 5 will assist in understanding this flow. The coolant may be water or other suitable fluid.

The coolant enters the heat exchanger 24 at inlet 34 and travels to the semi-circular groove 70A. The coolant travels through the axial slots 64 to the groove 74A and then through passage 82A into groove 76A and through passage 82C into groove 78A. From grooves 76A and 78A, the coolant travels axially upward through the communicating slots 62 and 60 into circular grooves 68 and 66 and into the remainder of the axial slots 62 and 60 into the grooves 78B, 76B. Then the fluid travels through passages 82B and 82D into groove 74B, then through the remainder of the axial slots 64 axially upward to the groove 70B and to outlet 32.

High pressure, hot fluid, which may be water, flows along the shaft 16 and enters the heat exchanger through the bottom of the annulus between the shaft and the aforesaid inside diameter 28; it flows in a path through the circular passages defined by the spaces between the baffle 50 and the cylindrical members 44 and 38, and out into a chamber adjacent the mechanical seal chamber. The baffle 50 and the cylindrical members 44 and 38 guide the flow of the hot fluid, and further, when the baffle rotates, the hot fluid rotates with it; hence, the coefficient of heat transfer to the coolant is enhanced. For example in a typical structure, using water at tap temperature as the coolant, it has been possible to cool hot water entering the exchanger at 550° F to an exit temperature of 150° F.

I claim:

1. A heat exchanger for a pump-mechanical seal assembly which comprises:

at least a pair of generally cylindrical housing members surrounding the driving shaft from the motor to the pump impeller;

each housing member having a plurality of concentric partitions which define with one another a plurality of concentric cylindrical openings communicating with one another, and also a plurality of circumferential grooves and axial slots, which grooves and slots communicate with one another;

a cooling fluid inlet and a cooling fluid outlet each connected to the outermost circumferential groove;

said outermost circumferential groove being separated into two segments, one segment being connected to said inlet and the other segment being connected to said outlet;

means defining a path for the flow of hot fluid from said pump into said cylindrical openings in a zigzag path for discharge from said exchanger, and said grooves and slots being so constructed and arranged that cooling fluid flows in a path substantially counter to said hot fluid through one segment of the outermost groove, into the outermost slots communicating therewith and thence into interior slots communicating with said outermost slots to the other segment of said outermost groove and then to said outlet.

2. A heat exchanger as recited in claim 1 (in which one of said) further comprising a rotating housing member (is) fixed to said shaft to rotate therewith to provide rotary movement to said hot fluid flowing from said pump to said mechanical seal.

3. A heat exchanger as recited in claim 2 in which the rotating housing member defines with another housing member said cylindrical openings for the flow of hot fluid.

4. A heat exchanger as recited in claim 1 in which said at least a pair of generally cylindrical housing members surround the drive shaft between the pump impeller and said mechanical seal assembly.

5. A heat exchanger as recited in claim 1 in which at least one of said concentric partitions has an inner and an outer axial portion, one of said axial portions having circumferentially spaced, axially extending ribs supporting said other axial portion, said axial slots being defined between said ribs.

* * * * *

UNITED STATES PATENT OFFICE

CERTIFICATE OF CORRECTION

PATENT NO. : 4,005,747

DATED : February 1, 1977

INVENTOR(S) : ROWLAND E. BALL

It is certified that error appears in the above-identified patent and that said Letters Patent are hereby corrected as shown below:

In accordance with Rule 323, please correct the following errors in the above patent:

Column 4, lines 37 and 38, cancel -- (in which one of said) --;

line 39, cancel -- (is) --.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*